United States Patent [19]

Mitchell

[11] 4,295,954

[45] Oct. 20, 1981

[54] COAL CONVERSION CATALYSTS

[75] Inventor: Thomas O. Mitchell, Trenton, N.J.

[73] Assignee: Mobil Oil Corporation, New York, N.Y.

[21] Appl. No.: 86,212

[22] Filed: Oct. 18, 1979

[51] Int. Cl.[3] ..... C10G 1/06

[52] U.S. Cl. ..... 208/10

[58] Field of Search ..... 208/10

[56] References Cited

U.S. PATENT DOCUMENTS 3,162,594 12/1964 Gorin ..... 208/57

3,232,861 2/1966 Gorin et al. ..... 208/10

3,488,279 1/1970 Schulman ..... 208/112

3,527,691 9/1970 Hodgson ..... 208/10

3,549,512 12/1970 Hodgson ..... 208/10

*Primary Examiner*—Delbert E. Gantz

*Assistant Examiner*—William G. Wright

*Attorney, Agent, or Firm*—C. A. Huggett; M. G. Gilman; C. J. Speciale

[57] ABSTRACT

A solvent extraction process for coal conversion wherein coal liquids are contacted with spent petroleum hydrogenation catalyst or spent demetallizing guard chamber adsorbent.

5 Claims, No Drawings

COAL CONVERSION CATALYSTS

BACKGROUND OF THE INVENTION

1. Field of the Invention

The present invention relates to the conversion of coal into liquid hydrocarbon products by reacting hydrogen with coal in the presence of a hydrogen-donor-solvent. More particularly, the present invention relates to the catalytic hydrotreatment of coal and coal liquids to effect removal of metals and heteroatoms.

2. Description of the Prior Art

Solvent extraction processes for converting coal to clean liquid or solid fuels generally comprise the following steps:

(1) coal extraction;

(2) separation of extract from undissolved residue; and (3) hydrogenation of the separated extract.

In the coal extraction step, coal is slurried in an organic solvent and heated, often in the presence of added molecular hydrogen, to a temperature sufficient to dissolve or liquefy most of the organic material in the coal. A wide variety of solvents are known in the art, including hydrogen donor solvents, non-hydrogen donor solvents, and mixtures thereof. The solvent employed may be obtained from a previous conversion of coal or may be a solvent generated externally of the solvent extraction process or may be mixtures thereof. Thus, the solvent may be the liquid wherein the liquid product obtained by solvent extraction is dissolved, as well as the liquid in which the undissolved solids from the coal extraction are dispersed.

After extraction, solids that are present may be removed from the product stream. The product stream, separated from undissolved residue, may then be stripped of solvent and the solvent recycled to the extraction step. The remaining extract, which will hereinafter be referred to as "solvent-refined coal," is a solid at room temperature and contains very little (generally less than 10 weight percent) material boiling below 850° F. The solvent-refined coal (which may still contain some "solvent") may thereafter be subjected to distillation to obtain products of various boiling ranges, some of which are useful as fuels. These fractions may then be further treated by refining processes, including coking, hydrogenation, cracking, hydrocracking, hydrotreating, and the like.

Alternatively, the product stream containing the solvent refined coal may be subjected to further treatment without first removing the solvent. It is known that such processing schemes have the advantage of treating an easier-to-handle material than those in which the solvent is separated before further treatment. Again, the mixture containing solvent-refined coal may be further treated by fractionation, coking, hydrogenation, cracking, hydrocracking, and the like.

A wide variety of materials have been suggested as suitable catalysts for coal liquefaction, coal liquefaction upgrading, and coal liquefaction solvent rehydrogenation. It is known that any conventional type of catalyst commonly used for hydrogenation of coal extract may catalyze desirable reactions in the first coal liquefaction zone. Moreover, since coal liquefaction catalysts are rapidly deactivated, employment of inexpensive hydrogenation catalysts which are only sufficiently active to accomplish the conversion of benzene insoluble extract to benzene solubles is desirable. For example, inexpensive, low-activity catalysts which have been suggested for coal liquefaction and initial catalytic upgrading of coal liquefaction products include spent catalysts from subsequent coal liquid treatment steps. U.S. Pat. No. 3,162,594 at column 8, lines 10–25 suggests that deactivated catalysts from a coal liquefaction product catalytic hydrocracking zone is a desirable coal liquefaction zone catalyst. Known coal liquefaction product hydrocracking catalysts are supported metals of Subgroups V–VIII of the Periodic Table. U.S. Pat. No. 3,232,861 suggests contacting deashed coal extract in a "prehydrocracking zone" with abraded catalyst fines recovered from a subsequent hydrocracking zone. See also U.S. Pat. No. 3,488,279.

In coal dissolution by liquefaction hydrogen donor techniques and in mild upgrading of the initially formed products to produce an acceptable boiler fuel or feedstock for further upgrading, there is a need for novel and inexpensive catalysts. An object of the present invention is an economically attractive catalytic process for the liquefaction of coal in a hydrogen donor solvent and for the mild upgrading of the initially formed product. A related object is an inexpensive, disposable material which catalyzes hydrogen interchange and metals and heteroatom removal in solvent extraction processes for the conversion of coal to more valuable hydrocarbon materials.

SUMMARY OF THE INVENTION

Coal liquefaction systems are characterized by high sulfur, nitrogen, metals, and coke precursor concentrations. The difficulty of recovery and regeneration of catalysts makes "throw-away" catalysts attractive. Fortunately, the requirements for a satisfactory catalyst are not stringent. Cracking activity is not desirable. Metals removal requires only a sufficiently high surface area. Heteroatom removal need not be nearly complete. Hydrogenation activity need not be high since the principal reaction required is the easy hydrogenation of aromatics to hydroaromatics and only a low conversion is desired. Avoidance of coking is not critical because a certain amount of hydrocarbonaceous residue is needed in liquefaction processes for the production of process heat and hydrogen.

It has been discovered that certain spent hydrogenation catalysts and spent material from guard chambers used to demetalize high quality feeds are highly desirable coal conversion catalysts. These catalysts may be slurried with the coal in the initial dissolution stage, or may be used in a separate step after coal mineral matter and insoluble hydrocarbons have been removed. In the latter case, the catalyst may be reused.

DETAILED DESCRIPTION OF THE INVENTION

The term "hydrogenation" is used in the petroleum refining art to cover a wide variety of processes which may be grouped into three broad classifications: hydrogen treating, aromatic saturation, and hydrocracking. Hydrogen treatments are mild operations that stabilize petroleum products or eliminate foreign elements from them. Stabilization results from converting reactive materials, especially diolefins, to less reactive ones. "Foreign" elements removed by hydrogenation include sulfur, nitrogen, oxygen, halides, and trace metals. Hydrogen treating is applied to stocks of all boiling ranges from light naphthas to lubricating oils. Aromatic saturation is employed to upgrade distillate fuels or lubricating oils or to improve charge stocks to catalytic cracking, especially recycle stocks. Hydrocracking is cracking under a substantial pressure of hydrogen. The hydrogen functions to suppress the formation of tar and coke and under certain conditions to convert polycyclic aromatics which are very refractory to materials which crack more readily. Any of a wide variety of heavy petroleum stocks are hydrocracked with varying degrees of severity.

A large number of catalysts have been developed for hydrogenating petroleum stocks. Suitable catalysts for the hydrotreating of hydrocarbon feedstocks include molybdenum oxide or sulfide, nickel-tungsten sulfide and other nickel catalysts, cobalt molybdate, and mixtures of cobalt oxide and molybdenum oxide supported on an alumina-containing support or base, usually activated or adsorptive alumina. Spent catalysts are frequently rich in valuable materials, containing more than about 1% molybdenum and 0.5% cobalt or nickel.

Hydrocracking catalysts comprise acidic supports, particularly silica-alumina composites having at least one hydrogenating/dehydrogenating component disposed thereon. Hydrogenating/dehydrogenating components are any one or more of the various Group VI and VIII metals, as well as the oxides and sulfides thereof, representative materials being the oxides and sulfides of molybdenum, tungsten, chromium, and the like and such metals as nickel and cobalt and the various oxides and sulfides thereof. More than one hydrogenating/dehydrogenating component may be present, e.g., composites of two or more of the oxides and sulfides of molybdenum, cobalt, nickel and tungsten.

Guard material is sometimes used when feedstocks having unacceptably high metals contents are subjected to catalytic treatment. For example, activated alumina is employed to remove iron from distillates obtained in Fischer-Tropsch processes prior to hydrotreatment. As a further example, activated alumina is employed to remove iron and arsenic from shale oil to protect a downstream hydrotreatment catalyst from these poisons.

As used herein, the term "spent petroleum hydrogenation catalysts" includes used catalytic material from hydrogen treating, aromatic saturation, and hydrocracking of petroleum or petroleum-derived materials. The determination of when a particular hydrogenation catalyst or guard material becomes "spent" is not a part of this invention. However, that determination is one readily apparent to those skilled in the art.

For example, tests are widely known and used for measuring the activity of cracking catalysts generally and hydrocracking catalysts in particular. Activity indices, broadly defined, are the yields of gasoline produced from a specific charge stock under standard conditions of pressure, temperature, space rate, and time on stream. These tests, together with observations of the operating processes enable a skilled person to ascertain when any given catalyst is "spent".

To give a specific example, the fluid activity index (FAI) is a method used to measure the relative cracking activity of fluidized catalysts. The test is carried out in a fixed fluidized bed containing 180 grams of the catalyst using Light East Texas Gas Oil as feed with 3% water (based on feed) added. The standard conditions are atmospheric pressure, 850° F., a weight hourly space velocity of 6, a catalyst to oil ratio of 2, and a time on stream of five minutes. A typical fresh hydrocracking catalyst has an FAI of about 80. Equilibrium catalysts removed from a hydrocracking unit for disposal have an FAI of 45–55 coked and 50–65 burned clean. The FAI of the spent catalyst is inadequate for the exacting requirements of a hydrocracking unit, but clearly most of the activity remains. This catalyst which otherwise would be disposed of is an example of the coal conversion catalysts of the present invention.

Spent catalysts from processes for the hydrogenation of hydrocarbons other than petroleum or petroleum-derived materials have also been found to be desirable catalysts in the process of the present invention. The following examples show that a spent hydrotreating catalyst from a process for hydrotreating hydrocarbon distillates synthesized in a Fischer-Tropsch type coal conversion process are useful catalysts in the coal liquefaction or solvent-refined coal process of the present invention. Such distillates are exemplary of high quality hydrocarbons derived from coal conversion processes comprising coal gasification and synthesis of liquid hydrocarbons from the products of coal gasification, and are referred to herein as "Fischer-Tropsch liquids". Catalytic hydrogenation of other high quality hydrocarbons also produce spent catalysts useful in the process of the present invention, a specific example being liquid hydrocarbons derived from oil shale. These materials are referred to herein as "shale oils".

The catalysts of the present invention are spent hydrogenation catalysts from processes for the hydrogenation of petroleum, petroleum-derived liquids, Fischer-Tropsch liquids, and shale oils and spent adsorbent from guard chambers used to demetalize such materials. Spent catalysts, particularly useful as catalysts in the process of the present invention comprise alumina or a crystalline or amorphous aluminosilicate having metals oxides or sulfides or iron or nickel deposited thereon. Refineries and heavy liquids upgrading processes generate large amounts of such spent catalysts that are discarded or sold. Their use as coal conversion catalysts does not affect this final disposition but allows additional use to increase the quantity and quality of the product obtained from coal extraction processes.

The coal liquefaction and coal liquefaction product upgrading catalysts of the present invention may be incorporated into known solvent extraction processes for converting coal to clean liquid or solid fuels in a variety of ways. The catalysts may be slurried with the coal in the initial dissolution stage. The catalyst may be added to the coal liquefaction product of the initial dissolution stage, after removal of coal mineral matter and insoluble hydrocarbons. The catalysts may be used to catalyze hydrogenation and heteroatom removal of process-derived solvent recycled to the initial dissolution stage. In the latter cases, the catalyst may be regenerated and reused.

EXAMPLES

Catalysts of the present invention have been tested for their activity and selectivity in a wide variety of reactions important in coal liquefaction and coal liquids upgrading and have been compared with a commercially prepared petroleum resid hydrotreating catalyst. Two synthetic mixtures which are modeled after process-derived coal products were used in the tests. The model mixture generally represents any coal liquid derived by direct hydrogenation and differs from actual coal liquids only in the molecular weight of its components and therefore, its boiling range. The chemical functionality of the model mixture is the same as that found in coal liquids. One mixture contained organic nitrogen compounds and one did not. In all of the examples, synthetic mixture was contacted with catalyst in a laboratory flow unit operated under the following conditions: a temperature of about 700° F. (371° C.), a pressure of about 1500 psig, a hydrogen partial pressure of about 1400 psig, about 2 hrs.$^{-1}$ WHSV, and a hydrogen circulation rate of 6500 SCF/BBL.

Three catalysts were tested: (1) Harshaw 618x, a commercially prepared petroleum resid hydrotreating catalyst composed of 2.7% nickel oxide and 14.8% molybdenum oxide on alumina containing 1.4% silica and having a surface area of 140 $m^2/g$ and an average pore diameter of about 170 A; (2) a spent hydrotreating catalyst previously employed for hydrotreating a 375°–950° F. distillate synthesized in a Fischer-Tropsch coal conversion process; and (3) spent alumina guard material used to protect the hydrotreating catalyst by removing iron from the distillate fed to the DHT catalyst of (2). The fresh DHT catalyst [(2), supra] was a commercially available cobaltmolybdena on alumina catalyst, manufactured by Ketjen and designated 165-1.5E. The fresh guard material [(3), supra] was activated alumina. Analyses of the spent DHT catalyst and guard material employed in the present tests are described in the following table.

TABLE I

| Spent Catalyst Properties | Alumina Guard Material | DHT Catalyst |
|---|---|---|
| Coke, wt. % | 11.1 | 14.7 |
| Sulfur; wt. % | 3.1 | 11.2 |
| Iron, wt. % | 4.8 | 15.6 |

EXAMPLES 1–3

In the examples, a synthetic coal product mixture having the composition shown in Table II was prepared and contacted as described above with the catalytic materials. Results are shown in Table III.

TABLE II

| Synthetic Mixture Composition | |
|---|---|
| Component | Wt. % of Mixture |
| Mesitylene | 49.9 |
| Phenanthrene | 10.0 |
| Benzothiophene | 10.0 |
| α-Naphthol | 10.0 |
| p-Cresol | 10.0 |
| Dibenzofuran | 10.0 |
| n-Heptyl Mercaptan | 0.1 |
| Elemental Analysis | |
| C | 86.2 |
| H | 7.8 |
| O | 3.5 |
| S | 2.4 |

Important reactions indicated by the catalystic hydrogenation of the synthetic mixture used in Examples 1–3 are solvent and coal liquefaction product hydrogenation, desulfurization, and deoxygenation. In particular, the tests show catalytic effects on phenanthrene hydrogenation to its partially saturated derivatives, 9,10-dihydrophenanthrene, tetrahydrophenanthrene, and octahydrophenanthrene, and the completely saturated derivative, perhydrophenanthrene. The result designated "% phenanthrene hydrogenation" in Table III is the average fraction of the addition of sufficient hydrogen to make perhydrophenanthrene from phenanthrene. The tests also show organic sulfur removal from compounds such as benzothiophene and n-heptylmercaptan and organic oxygen removal from compounds such as p-cresol, α-naphthol, and dibenzofuran.

A control run using Vycor as the contact material was also performed, but the only reaction found was some conversion of α-naphthol. Otherwise, the synthetic mixture was unaffected.

The results clearly demonstrate that the spent catalytic materials of the present invention compare very favorably with the fresh commercial catalyst for hydrogenation and removal of sulfur and oxygen. Each of Examples 1–3 produced substantial quantities of tetralin, a partially saturated hydroaromatic compound known to possess excellent hydrogentransfer properties. Table III shows the weight percent tetralin found in the products as an indication of catalytic selectivity to form material promoting coal liquefaction.

TABLE III

| Results of Examples 1–3 | | | |
|---|---|---|---|
| Example No. | 1 | 2 | 3 |
| Catalyst | Harshaw 618X | Aged DHT Catalyst | Spent $Al_2O_3$ Guard Material |
| Time on stream, hr. | 14.0 | 20.0 | 18.5 |
| % Desulfurization | 96 | 76 | 91 |
| % Deoxygenation | 30 | 77 | 41 |
| % Hydrogen in Product | 8.83 | 9.01 | 9.08 |
| % Phenanthrene Hydrogenation | 17.46 | 19.25 | 18.17 |
| Tetralin (wt. % of product) | 6.4 | 6.2 | 5.9 |

EXAMPLES 4–6

In these examples, a synthetic coal product mixture having the composition shown in Table IV was prepared and contacted as described above with the catalytic materials. Results are shown in Table V.

TABLE IV

| Synthetic Mixture Composition | |
|---|---|
| | Weight % of Mixture |
| Component | |
| Mesitylene | 45.1 |
| Phenanthrene | 9.0 |
| Benzothiophene | 9.0 |
| α-Naphthol | 9.8 |
| γ-Picoline | 9.0 |
| Indole | 9.0 |
| Quinoline | 9.0 |
| n-Heptyl Mercaptan | 0.1 |
| Elemental Analysis | |
| C | 86.0 |
| H | 7.7 |
| O | 1.1 |
| N | 3.1 |
| S | 2.1 |

TABLE V

| Results of Examples 4–6 | | | |
|---|---|---|---|
| Example No. | 4 | 5 | 6 |
| Catalyst | Harshaw 816X | Aged DHT Catalyst | Spent $Al_2O_3$ Guard Material |
| Time on stream, hrs. | 21.0 | 15.0 | 12.0 |
| % Desulfurization | 94 | 86 | 70 |
| % Denitrogenation | 15 | 25 | 11 |
| % Deoxygenation | 55 | 45 | 52 |
| % H in Product | 9.03 | 9.28 | 9.05 |
| % Phenanthrene | | | |

TABLE V-continued

| Example No. | Results of Examples 4–6 | | |
|---|---|---|---|
| | 4 | 5 | 6 |
| Catalyst | Harshaw 816X | Aged DHT Catalyst | Spent $Al_2O_3$ Guard Material |
| Hydrogenation | 20.23 | 18.53 | 14.25 |
| Tetralin (wt. % of of product) | 6.2 | 6.2 | 5.5 |

Important reactions indicated by the catalytic hydrogenation of the synthetic mixture used in Examples 4–6 include solvent and coal liquefaction product denitrogenation in addition to those reactions indicated in Examples 1–3. Table V shows enhanced organic nitrogen removal when the spent catalysts of the present invention were used. Again, the results clearly demonstrate that the spent catalytic materials of the present invention compare very favorably with the fresh commercial catalyst for hydrogenation and removal of sulfur and oxygen.

What is claimed is:

1. In a solvent extraction process for coal conversion wherein coal is slurried in an organic solvent and heated to a temperature sufficient to dissolve or liquefy most of the coal, the resulting coal liquefaction product is upgraded by catalytic hydrogenation, and a process-derived recycle solvent is hydrogenated and returned to the initial dissolution stage; the improvement which comprises contacting a coal/solvent slurry, with a catalyst selected from the groups consisting of:

(1) spent hydrogenation catalyst from processes for the hydrogenation of hydrocarbons selected from the group consisting of petroleum, petroleum-derived liquids, Fischer-Tropsch liquids, and shale oils;

(2) spent adsorbent from guard chambers used to demetallize said hydrocarbons; and (3) mixtures thereof.

2. The process of claim 1 wherein said catalyst further comprises alumina having metals, oxides, or sulfides of iron or nickel deposited thereon.

3. The process of claim 1 wherein said catalyst further comprises a crystalline aluminosilicate having metals, oxides, or sulfides of iron or nickel deposited thereon.

4. The process of claim 1 wherein said coal/solvent slurry is contacted with said catalysts.

5. The process of claim 1 wherein said catalyst is spent hydrogenation catalyst from processes for the hydrogenation of petroleum or petroleum-derived liquids.

* * * * *